US012268944B2

(12) United States Patent
Waffensmith

(10) Patent No.: US 12,268,944 B2
(45) Date of Patent: Apr. 8, 2025

(54) BRIDGING COMPONENT FOR MODULAR TRAINING SYSTEM

(71) Applicant: Omnitool, Inc., Minneapolis, MN (US)

(72) Inventor: Jeff Waffensmith, Minneapolis, MN (US)

(73) Assignee: Omnitool, Inc., Minneapolis, MN (US)

( * ) Notice: Subject to any disclaimer, the term of this patent is extended or adjusted under 35 U.S.C. 154(b) by 1120 days.

(21) Appl. No.: 17/113,792

(22) Filed: Dec. 7, 2020

(65) Prior Publication Data

US 2021/0113903 A1 Apr. 22, 2021

Related U.S. Application Data

(63) Continuation-in-part of application No. 16/425,531, filed on May 29, 2019, now Pat. No. 11,331,552.

(60) Provisional application No. 62/944,973, filed on Dec. 6, 2019, provisional application No. 62/677,837, filed on May 30, 2018.

(51) Int. Cl.
*A63B 69/00* (2006.01)
*A63B 17/04* (2006.01)

(52) U.S. Cl.
CPC ..... *A63B 69/0026* (2013.01); *A63B 17/04* (2013.01)

(58) Field of Classification Search
CPC ..... A63B 69/00026
USPC ..... 473/446
See application file for complete search history.

(56) References Cited

U.S. PATENT DOCUMENTS 1,963,056 A * 6/1934 Wilcox ..... E04C 3/07 473/322
3,952,690 A 4/1976 Rizzo et al.
4,147,347 A 4/1979 Angove
4,491,320 A 1/1985 Smith
(Continued)

FOREIGN PATENT DOCUMENTS

CA 1305731 C 7/1992
CA 2481818 A1 3/2006
(Continued)

OTHER PUBLICATIONS

Snipers Edge; "SweetHands Hockey Stickhandling Trainer"; Website product listing; https://www.snipersedgehockey.com/collections/top-sellers/products/sweethands-hockey-stickhandling-trainer?variant=164564992025; pp. 4.
(Continued)

*Primary Examiner* — Mitra Aryanpour
(74) *Attorney, Agent, or Firm* — GRUMBLES LAW PLLC; Brittany Haanan

(57) ABSTRACT

A modular training system for use by athletes to improve their stick-handling skills. More specifically, a modular training system comprising a mounting device and a bridging component. The mounting device can have a main body with two side projections that are structured and configured to together define a central channel therebetween; and at least one base portion located below the main body. Each side projection may have at least one tab projecting into the central channel for releasably securing the bridging component in a horizontal configuration within the central channel. The bridging component can have a tube, a base extending along a lower outer surface of the tube, and a plurality of projecting rails extending along left and right outer surfaces of the tube.

19 Claims, 6 Drawing Sheets

(56) References Cited

U.S. PATENT DOCUMENTS

| | | | | |
|---|---|---|---|---|
| 5,048,572 | A * | 9/1991 | Levine | F16L 9/21 174/DIG. 8 |
| 5,776,007 | A | 7/1998 | Kendall et al. | |
| 5,996,802 | A | 12/1999 | Parker et al. | |
| 6,165,084 | A | 12/2000 | Cranston | |
| 6,364,790 | B1 | 4/2002 | Carrie et al. | |
| 6,656,064 | B2 | 12/2003 | Zielinski | |
| 7,867,112 | B1 | 1/2011 | Giauque et al. | |
| 8,357,061 | B2 | 1/2013 | Quinn | |
| 9,494,258 | B2 * | 11/2016 | Flynn | F16L 3/237 |
| 10,532,260 | B2 * | 1/2020 | Del Monte | A63B 69/0026 |
| 11,857,857 | B2 * | 1/2024 | Hurwitz | A63B 71/0036 |
| 2003/0098545 | A1 | 5/2003 | Webb | |
| 2006/0063615 | A1 | 3/2006 | Richardson et al. | |
| 2008/0248902 | A1 | 10/2008 | Pittorf | |
| 2011/0210573 | A1 | 9/2011 | Wright | |
| 2012/0157242 | A1 | 6/2012 | Quinn | |
| 2017/0361190 | A1 | 12/2017 | Del Monte | |

FOREIGN PATENT DOCUMENTS

| | | | |
|---|---|---|---|
| CA | 2715697 | A1 | 3/2012 |
| CA | 2727515 | A1 | 7/2012 |
| CA | 177262 | | 5/2018 |
| CA | 2992873 | A1 | 7/2019 |
| EP | 2606944 | B1 | 8/2015 |

OTHER PUBLICATIONS

Reustix; "Our Story—ReUstix™"; Website, http://www.reustix.com/ourstuff; pp. 3.

Freeman Industries Inc; "Linwood Product Catalogue"; Product Catalogue; FI-6850; pp. 20.

Acon USA, Inc.; "ACON Wave Infinity Dangler"; Website product listing; https://us.acon24.com/products/acon-wave-infinity-dangler?variant=19684615290950; pp. 4.

Hockeyshot Inc.; "Fast Hands Stickhandling Trainer Aid." Website product listing; https://www.hockeyshot.com/Fast-Hands-Stickhandling-Trainer-Aid-Fast-Hands-Pro-p/stickhandling-aid-026-pro.htm; pp. 10.

Hockeyshot Inc.; "HockeyShot Extreme Dangler." Website product listing; https://www.hockeyshot.com/HockeyShot-Extreme-Dangler-p/stickhandling-aid-028.htm; pp. 13.

Itak Sport; "Mohawke Stick Handling Tool"; Website product listing; https://itaksport.com/other-accessories/49621-mohawke-stick-handling-tool-7340068127503.html; pp. 2.

Hockey Revolution; "Hockey Revolution Stickhandling Training Aid, Equipment for Puck Control, Reaction Time and Coordination 2nd Generation;" Website product listing; https://www.amazon.com/Hockey-Revolution-Stickhandling-Equipment-Coordination/dp/B0773XLJBL; pp. 8.

* cited by examiner

BRIDGING COMPONENT FOR MODULAR TRAINING SYSTEM

CROSS-REFERENCE TO RELATED APPLICATION

This application incorporates by reference U.S. Nonprovisional application Ser. No. 16/425,531, filed May 19, 2019 and titled MODULAR TRAINING DEVICE, U.S. Provisional Patent Application Ser. No. 62/677,837, filed May 30, 2018 and titled MODULAR TRAINING DEVICE, and U.S. Provisional Patent Application Ser. No. 62/944,973, filed Dec. 6, 2019 and titled BRIDGING COMPONENT FOR MODULAR TRAINING SYSTEM, such incorporation being limited such that no subject matter is incorporated that is contrary to the explicit disclosure herein.

BACKGROUND OF THE INVENTION

A main objective in the sport of hockey is to put the hockey puck into the opposing team's net. To accomplish this, players must maintain possession of the hockey puck by using a hockey stick to handle and pass the hockey puck between each other. Therefore, a desired skill in the sport of hockey is the ability to hold onto and precisely pass the hockey puck. To improve this skill, teams hold practices where coaches run specific stick-handling drills for the players. Additionally, players often work on their own at home or on the ice to improve their stick-handling skills.

However, there are current limitations and disadvantages to available training tools. More specifically, the majority of available training tools have several components, may only be available in a single configuration, and/or may be heavy and, therefore, difficult to transport. Consequently, a new training tool is needed that is modular, lightweight, and transportable.

SUMMARY OF THE INVENTION

The disclosed device is a modular training system, which can be used by athletes, such as hockey players, to improve their stick-handling skills. More specifically, in one embodiment, the modular training system is comprised of a mounting device and a bridging component. The mounting device may be comprised of a main body with two side projections that, together, define a central channel therebetween, wherein each side projection has at least one tab projecting into the central channel and at least one base portion located below the main body. The bridging component may have a tube, a base extending along a lower outer surface of the tube, and a plurality of projecting rails extending along left and right outer surfaces of the tube. The bridging component may be releasably secured to the mounting device in a horizontal configuration within the central channel. In some embodiments, the bridging component may be releasably secured to a second mounting device in a horizontal configuration within a central channel of the second mounting device.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings.

DETAILED DESCRIPTION

Figure 1:
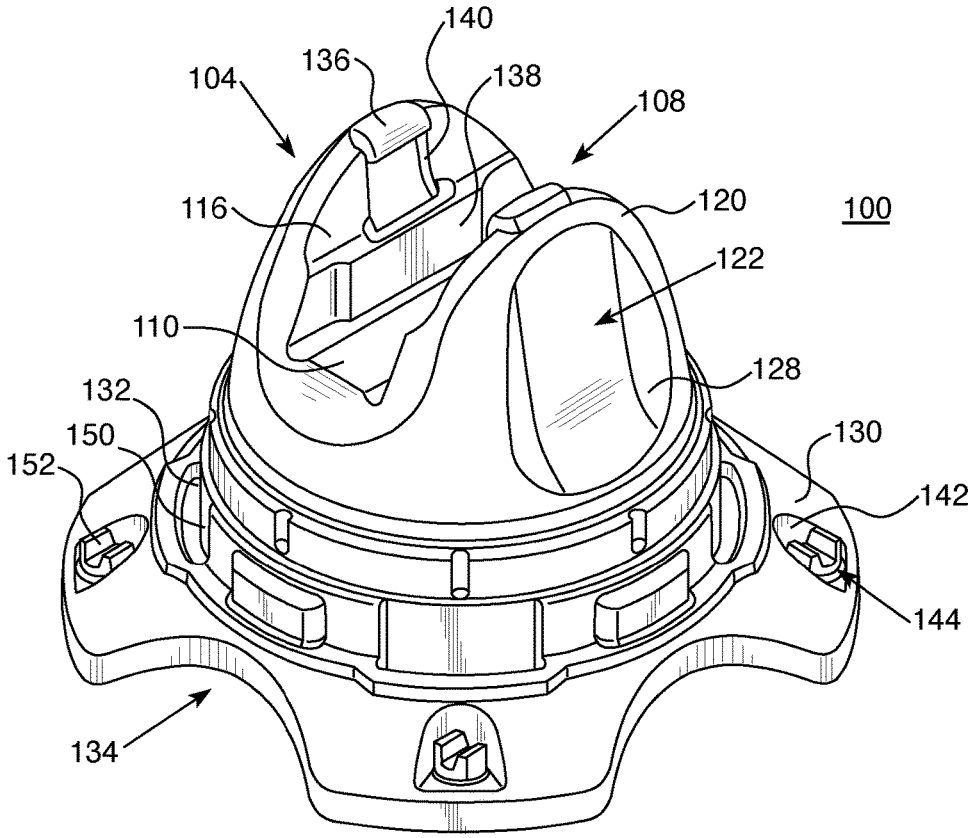
FIG. 1 is a front perspective view of a modular training device.

The present disclosure relates to training tools, and more particularly, relates to a modular training system for athletes. Various embodiments are described in detail with reference to the drawings, wherein like reference numerals may be used to represent like parts and assemblies throughout the several views. Reference to various embodiments does not limit the scope of the claims attached hereto. Examples of construction, dimensions, and materials may be illustrated for the various elements, but those skilled in the art will recognize that many of the examples provided herein have suitable alternatives that may be utilized. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The disclosed system is a modular training system used by athletes, such as hockey players, to improve their stick-handling skills. For example, multiple mounting devices can each be coupled with an elongated object, such as a bridging component, to create a multi-barrier, bridged system around and under which an athlete can direct a hockey puck or training ball. More specifically, each of the mounting devices can act as a riser to which a bridging component, hockey stick, or cylindrical pipe can attach. Therefore, in use, an athlete can attempt to direct a hockey puck past one or more of the mounting devices and underneath the bridging component, hockey stick, or cylindrical pipe. For example, a set of mounting devices could be lined up in a row, the bridging component could couple with each mounting device along its shaft length, and an athlete could weave the puck around each mounting device while simultaneously keeping the puck on the ground so it does not make contact with the bridging component. Alternatively, an athlete could work on making passes on the ground by aiming to slot the puck between two mounting devices and underneath the bridging component. While not specifically described herein, other training drills are envisioned that could assist an athlete in improving their stick-handling skills.

Figure 2:
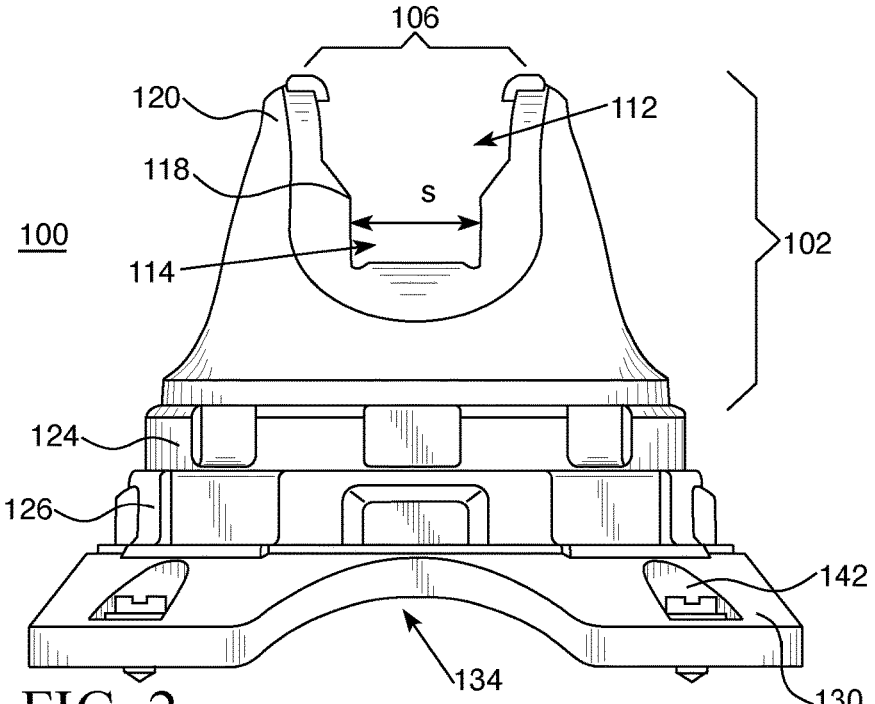
FIG. 2 is a front elevational view of the disclosed modular training device; a back elevational view is a mirror image of the front elevational view.
Figure 3:
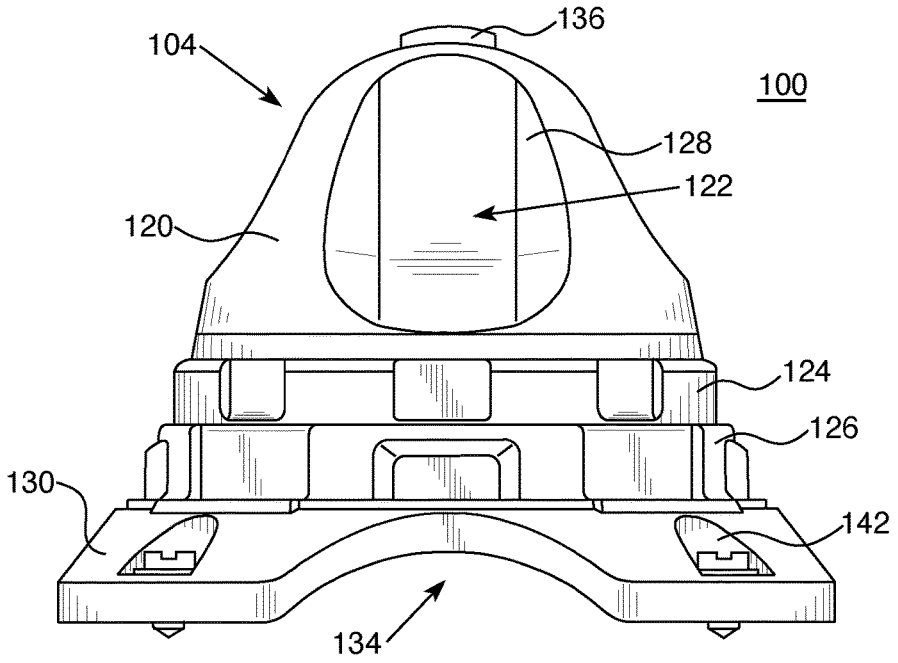
FIG. 3 is a side elevational view of the disclosed modular training device.

More specifically, in some embodiments, the modular training system includes a mounting device comprising a main body and at least one base portion. For example, as illustrated in FIGS. 1-11, mounting device 100 can include main body 102, which may, in some embodiments, form at least two vertical side projections 104. Side projections 104 can be positioned approximately parallel to each other and may define a gap or slot between them, such as central channel 106, with the central channel having top opening 108 and channel floor 110. In some embodiments, central channel 106 may also define upper cavity 112 and lower cavity 114 and may be open at the front and back of main body 102. Therefore, from a front view, as illustrated in FIG. 2, main body 102 may appear to approximately take the shape of a "U." As illustrated in FIGS. 2-3, side projections 104 can project orthogonal to circular base portions 124, 126.

Figures 7, 8:
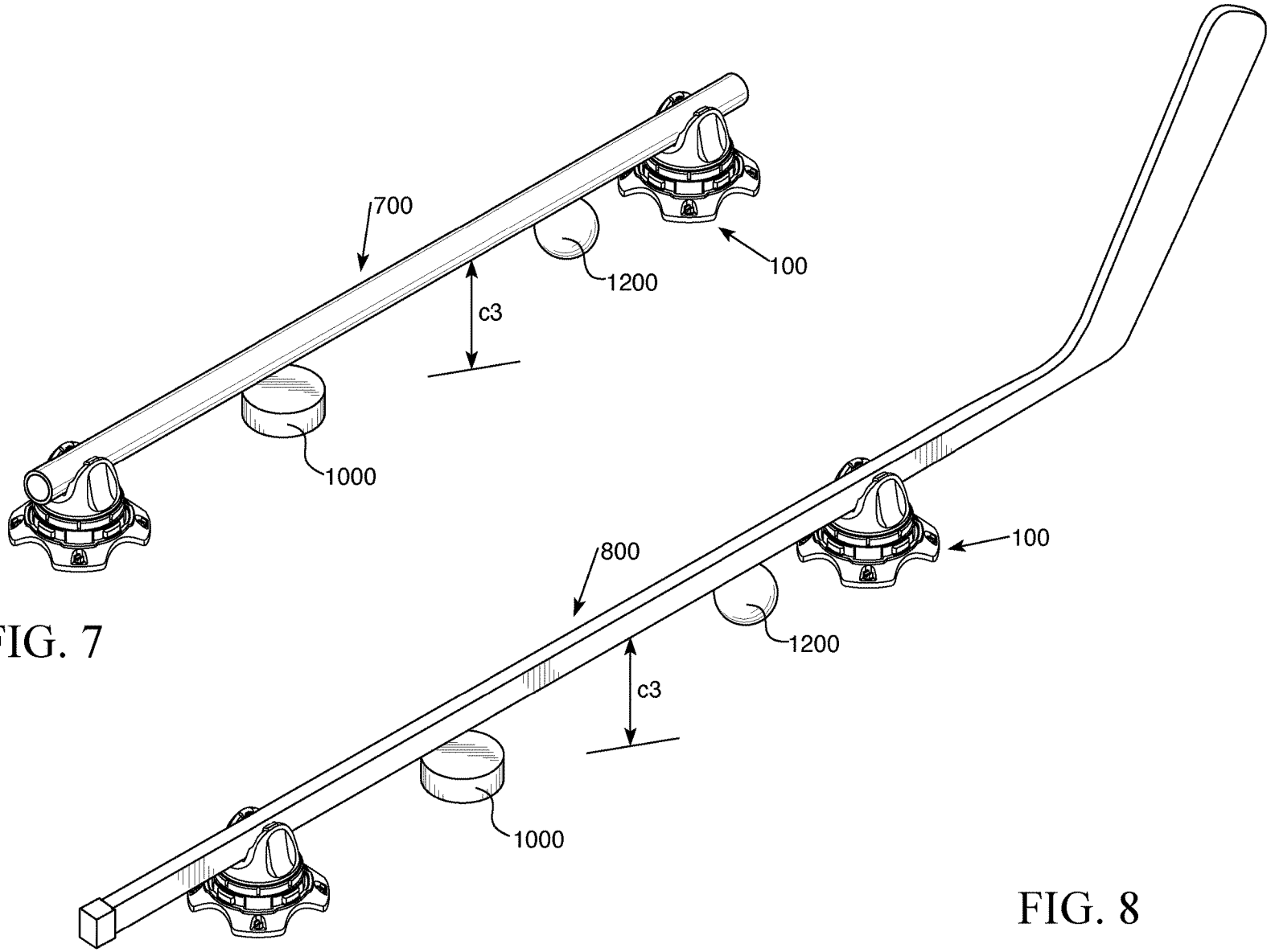
FIG. 7 illustrates one embodiment of the disclosed modular training device in use with a pipe.
FIG. 8 illustrates one embodiment of the disclosed modular training device in use with a hockey stick.

In use, side projections 104 are structured and configured to correspond to the profile of, and hold in place, everyday objects that may be found in a home, such as cylindrical pipe 700 (for example, a PVC pipe) or hockey stick shaft 800, as illustrated in FIGS. 7 and 8, respectively. In some cases, objects other than pipe 700 or hockey stick shaft 800 can be used, such as a cylindrical or rectangular bar or any other elongated object. For example, any elongated cylindrical or rectangular object having similar dimensions to that of pipe 700 and hockey stick shaft 800 can be coupled with mounting device 100 and used for training to improve stick-handling skills. In some cases, a specialized connection piece can be used, such as bridging component 900, which is illustrated in combination with mounting device 100 in FIGS. 9-11.

To securely couple the elongated object with mounting device 100, main body 102 can further include one or more tabs on inner surface 116 of one or more of side projections 104, wherein the inner surfaces face each other. In some embodiments, main body 102 may have one tab on inner surface 116 of each side projection 104, and the tabs may project into central channel 106. In other embodiments, main body 102 may have two tabs on inner surface 116 of each side projection 104 that project into central channel 106 and, together, releasably secure an elongated object in a horizontal configuration within the central channel. For example, if main body 102 is structured and configured to couple with pipe 700, hockey stick shaft 800, and/or bridging component 900 as illustrated in FIGS. 7-9, inner surface 116 may include two tabs: pipe tab 136 and shaft tab 138 as illustrated in FIGS. 1 and 4.

Accordingly, if, for example, main body is structured and configured to releasably secure pipe 700, as illustrated in FIG. 7, inner surface 116 may include two pipe tabs 136, one on each side projection 104. In some embodiments, pipe tabs 136 can releasably secure pipe 700 in place in upper cavity 112 so the pipe does not uncouple from mounting device 100 without substantial user force and effort. In some cases, pipe tabs 136 may be hooked elements that project from top and inner portions of side projections 104, as illustrated in FIGS. 1-2. Further, pipe tabs 136 may be rounded on top and include a flat underside that projects into central channel 106 and creates a shelf to catch pipe 700, as illustrated in FIG. 7, and prevent the pipe from accidentally releasing.

Figure 4:
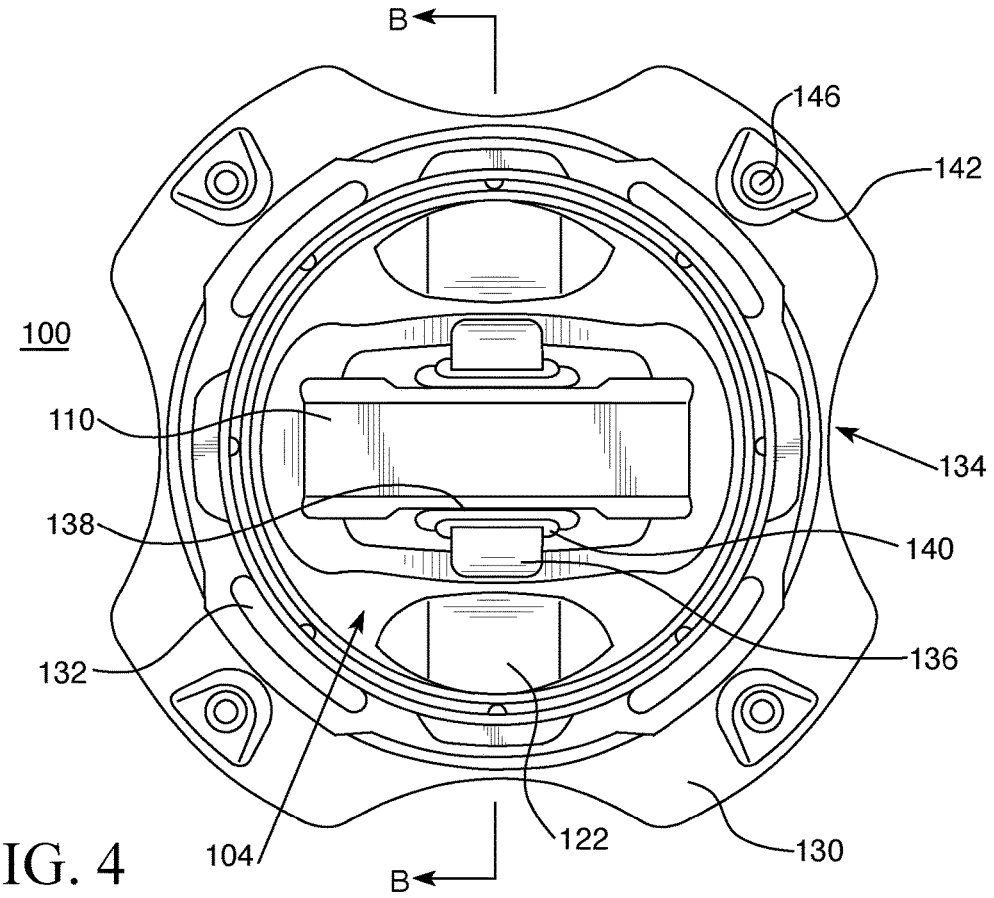
FIG. 4 is a top plan view of the disclosed modular training device.

In another example, if main body 102 is structured and configured to releasably secure hockey stick shaft 800, as illustrated in FIG. 8, inner surface 116 may include two shaft tabs 138, one on each side projection 104, as illustrated in FIGS. 1 and 4. When, for example, hockey stick shaft 800 is coupled with mounting device 100, the width of the hockey stick shaft is similar to the width between shaft tabs 138 so that shaft tabs on inner surfaces 116 of side projections 104 can secure the hockey stick shaft in lower cavity 114. This may result in the shaft tabs creating a friction fit with shaft 800 and preventing the hockey stick shaft from separating from mounting device 100 without substantial user force and effort.

Figure 9:
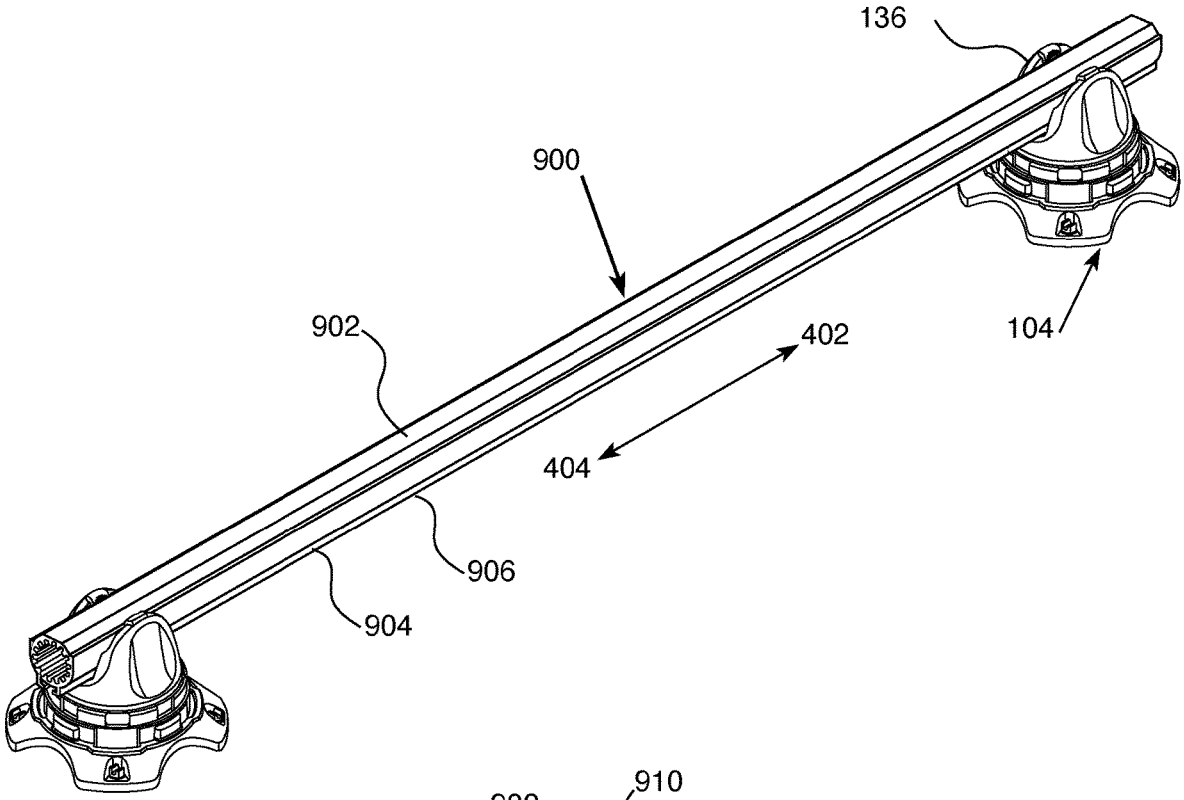
FIG. 9 illustrates one embodiment of the disclosed modular training device in use with a bridging component.
Figure 10:
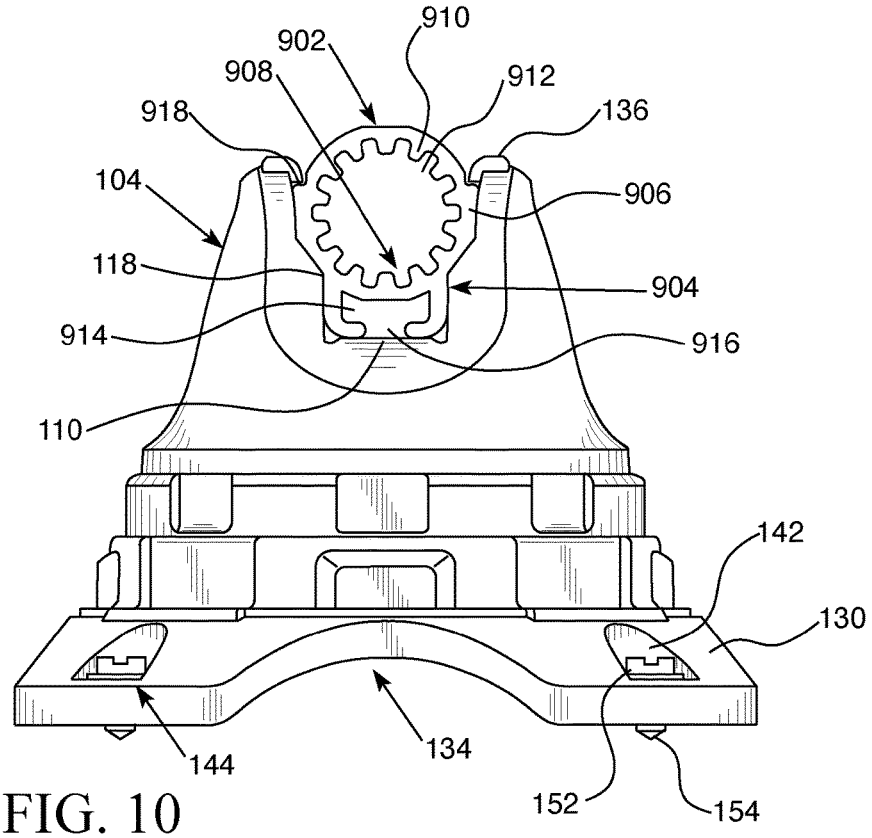
FIG. 10 is a front elevational view of the disclosed modular training device coupled to the bridging component.
Figure 11:
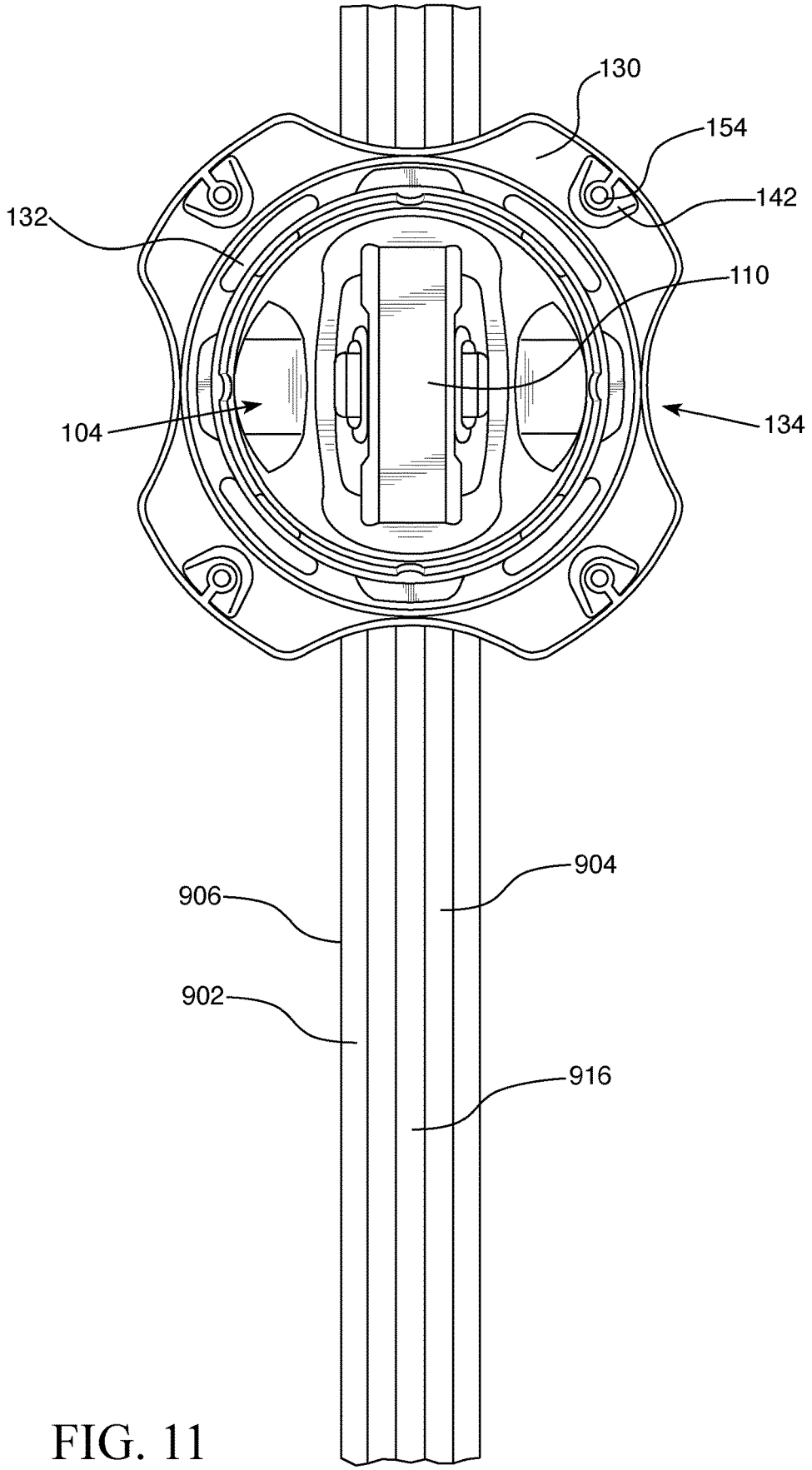
FIG. 11 is a bottom plan view of the disclosed modular training device coupled to the bridging component.

In yet another example, mounting device 100 can couple with bridging component 900, as illustrated in FIGS. 9-11, wherein bridging component 900 is releasably secured to mounting device 100 in a horizontal configuration within central channel 106. As illustrated in FIG. 9, bridging component 900 may be releasably secured to a plurality of mounting devices 100 in a horizontal configuration within central channel 106 of each mounting device 100. Bridging component 900 can be comprised of tube 902, base 904 extending along a lower outer surface of tube, and projecting rails 906 on the outer surface of tube 902. Bridging component 900 can be made of materials such as extruded plastic, metal, rubber, or any other material rigid enough to retain its form.

In some embodiments, tube 902 can be solid or hollow. In cases where tube 902 is hollow, it can have interior interface 908 comprising elongate ridges 910 that extend along the interior surface of tube 902 with channels 912 between each elongate ridge 910. Interior interface 908 enables additional training tools to be added to bridging component 900. More specifically, elongate ridges 910 and channels 912 may extend from one end of tube 902 to the opposite end and may, from a side view as illustrated in FIG. 10, appear tooth-like in that each elongate ridge 910 may have a rectangular cross-section, may protrude slightly into the hollow space of tube 902 without making contact with each other, and may be spaced equidistant from each other, therefore providing channels 912 with equal widths. However, equidistant spacing is not required, and elongate ridges 910 may have different, varying distances between each other such they are spaced at random intervals from each other and channels 912 have varying widths. In some embodiments, elongate ridges 910 and channels 912 may be molded simultaneously with tube 902. However, elongate ridges 910 and channels 912 may also be added after tube 902is extruded or otherwise shaped and created. Therefore, elongate ridges 910 and channels 912 may be made of the same material as tube 902 or they may be made of different material.

If tube 902 is hollow, it may also include a gap extending along its entire length. This gap may help tube 902 compress without breaking when it is coupled with mounting device 100. For example, if tube 902 is inserted into central channel 106 and it is slightly larger than the space allowed by central channel 106, having a gap can allow it flexibility to decrease its default radius. The gap may be located near a top surface of tube 902, a side surface of tube, or it may be located near a bottom surface so that it, in effect, is part of the shared top surface of base 904.

In some embodiments, base 904 of bridging component 900 has an outer surface defined by three walls and a lower outer surface of tube 902, as illustrated in FIG. 10. To best couple bridging component 900 to mounting device 100, the three walls of base 904 may substantially match the interior shape of lower cavity 114 of central channel 106. For example, the three walls may all have flat outer faces, two of the three walls may be parallel to each other and project radially outward from tube 902, and the third of the three walls may be perpendicular to the two, parallel walls. Further, base 904 can prevent rotation of tube 902 when coupled with mounting device 100.

As with tube 902, base 904 may be solid or hollow. In some embodiments, base 904 can have hollow channel 914. Hollow channel 914 can be rectangular and can be completely encased by the three walls and lower surface of tube 902, or base 904 can have an opening. For example, third, perpendicular wall, as described above, can have a gap extending along its length. For example, as illustrated in FIG. 10, base 904 has gap 916 running its entire length. In some embodiments, channel 914 can accept a connecting plate, such as a fastener or a locking plate, so that two or more channels, and thereby bridging components 900, can be connected together.

In addition to tube 902 and base 904, bridging component 900 can include projecting rails 906. Some embodiments of bridging component 900 may include two projecting rails 906, as illustrated in FIGS. 9-10, although a single rail or more than two rails are possible. Projecting rails 906 can extend continuously as solid pieces from the first end of tube 902 to the second end of tube 902, such that mounting device 100 can slide or translate the entire length of tube 902 uninterrupted, as illustrated by arrows 402, 404 in FIG. 9. Alternatively, projecting rails 906 may extend intermittently from the first end of tube 902 to the second end of tube 902, such that projecting rails 906 leave gaps along their lengths allowing for mounting device 100 to be joined with tube 902 at a specific point instead of having to slide from one end of tube 902 to the desired mounting point. This solution may help speed up placement of mounting device 100 at a specific point on bridging component 900.

In form, projecting rails 906 may each include a ledge 918, which can be a flat upper-facing face, and a sloped side that merges into tube 902. Ledge 918 of each projecting rail 906 may protrude out from the sides of tube 902 and may be spaced apart from each other such that they align underneath pipe tabs 136 of side projection 104 of mounting device 100 so that pipe tabs 136 act as a lock to keep bridging component 900 coupled with mounting device 100.

As described above, base 904 can be located beneath tube 902. The transition from tube 902 to base 904 can occur near stopping point 118 of inner surface 116, such that base 902 is located in lower cavity 114 and tube 904 is located in upper cavity 112, as illustrated in FIG. 10. Therefore, tube 902 can be effectively locked in place by the combination of projecting rails 918 and pipe tabs 136, and base 904 can be locked in place by shaft tabs 138. Depending on how far shaft tabs 138 protrude into lower cavity 114, they may push on the two, parallel walls of base 904 thereby decreasing the size of gap 916 in base 904.

In form, and as described above, the tabs can have beveled edges. For example, the tabs may be roughly circular and, therefore, have a dome-like shape. Alternatively, the tabs may be more elongated and, therefore, have a cylindrical shape. In another case, tabs 138 may be elongated but have a rectangular shape with beveled edges, as illustrated in FIG. 1. Further, tabs may be made of semi-rigid material while also maintaining flexibility, which enables them to indent slightly when pipe 700, hockey stick shaft 800, bridging component 900, or other elongated objects are coupled and uncoupled from mounting device 100. In some cases, each side projection 104 may have a cavity/open space behind the tabs to enable the tabs to flex when receiving or releasing an elongated object. In the case of tab 136, side projection may have cutout beneath the tab, such as cavity 140 of the side projection, as illustrated in FIG. 4, allowing the tab to flex down and, if necessary, into the cavity.

For example, as pipe 700 or tube 902 of bridging component 900 is inserted horizontally through top opening 108 and into upper cavity 112, pipe tabs 136 may indent or flex slightly to allow the pipe 700 or tube 902 to pass. After pipe 700 or tube 902 passes the apexes of pipe tabs 136, the pipe tabs may snap back into place, thus securing pipe 700 or bridging component 900 to mounting device 100. Similarly, as hockey stick shaft 800 or bridging component 900 is inserted horizontally through top opening 108 and upper cavity 112 and into lower cavity 114, shaft tabs 138 may indent or flex slightly to allow shaft 800 or base 904 of bridging component 900 to be inserted. However, if shaft tabs 138 are not located above the height of shaft 800 or base 904, the shaft tabs may remain compressed, and the friction fit between shaft tabs 138 and hockey stick shaft 800 or base 904 can keep shaft or bridging component 900 releasably secured to mounting device 100.

Figure 6:
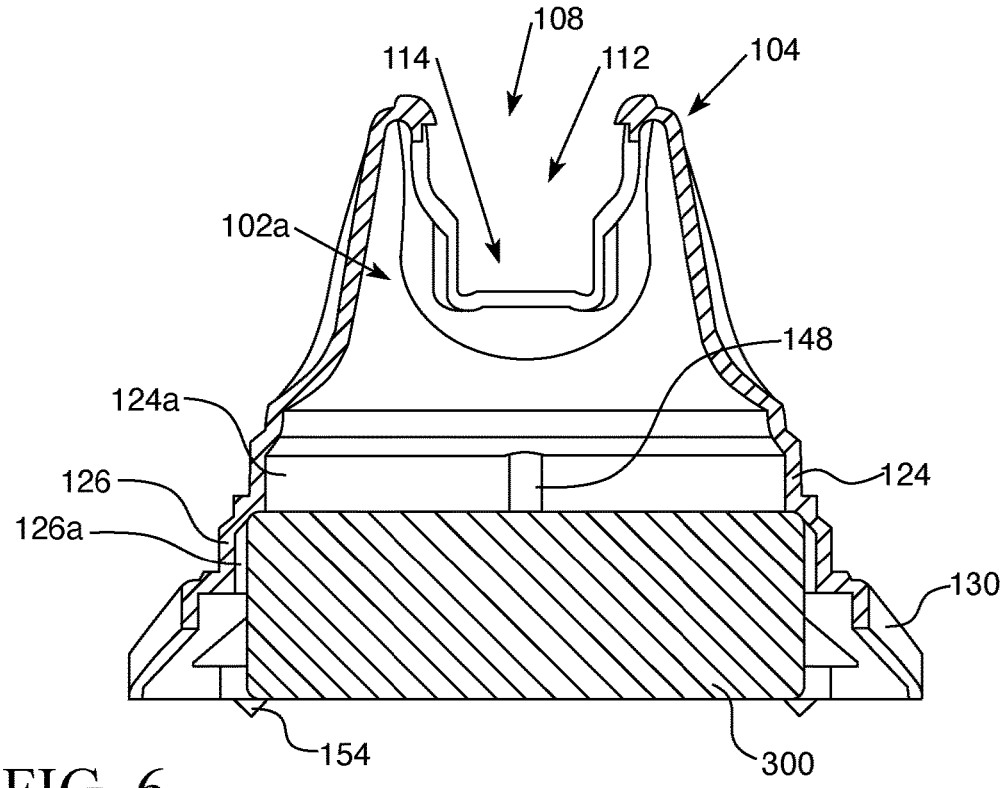
FIG. 6 is a front cross-sectional view of the disclosed modular training device taken from the line B-B in FIG. 4; a back cross-sectional view is a mirror image of the front cross-sectional view.

In some embodiments, inner surface 116 can slant or slope inward to assist in creating a stopping point 118 for, for example, pipe 700 or bridging component 900. For example, as illustrated in FIGS. 2 and 6, inner surfaces 116 may slope inward until distance of separation s between each side projections' inner surface is approximately equal to, but slightly wider than, the width of hockey stick shaft 800 or base 904. This enables mounting device 100 to accommodate pipe 700, hockey stick shaft 800, bridging component 900, or another elongated object in a horizontal position or configuration. More specifically, if user chooses to releasably secure pipe 700 to mounting device 100, pipe can be wedged between pipe tabs 136 and stopping point 118, and if user chooses to secure shaft 800 to device, shaft can be freely inserted past stopping point 118 until shaft comes into contact with shaft tabs 138 and channel floor 110. Bridging component 900 combines both concepts and enables pipe tabs 136 to releasably secure tube 902 to mounting device 100 via projecting rails 906 and also enables base 904 to be freely inserted past stopping point 118 until it comes into contact with shaft tabs 138 and channel floor 110.

In addition to coupling with elongated objects, such as pipe 700, hockey stick shaft 800, or bridging component 900, mounting device 100 may couple with hockey puck 300, as illustrated in FIG. 6. One potential benefit of coupling mounting device 100 with hockey puck 300 is that the clearance height of the combined two devices will be greater than a height of hockey puck 1000, as illustrated in FIGS. 7-8. Therefore, when, as described above, user is directing puck 1000 past one or more of mounting devices 100 and underneath hockey stick shaft 900, puck 1000 is able to freely pass under shaft 900 as long as it is sliding on one of its two flat faces. Another potential benefit of coupling mounting device 100 with hockey puck 300 is that the hockey puck will provide extra weight to prevent the device from unwanted excess movement.

Figure 5:
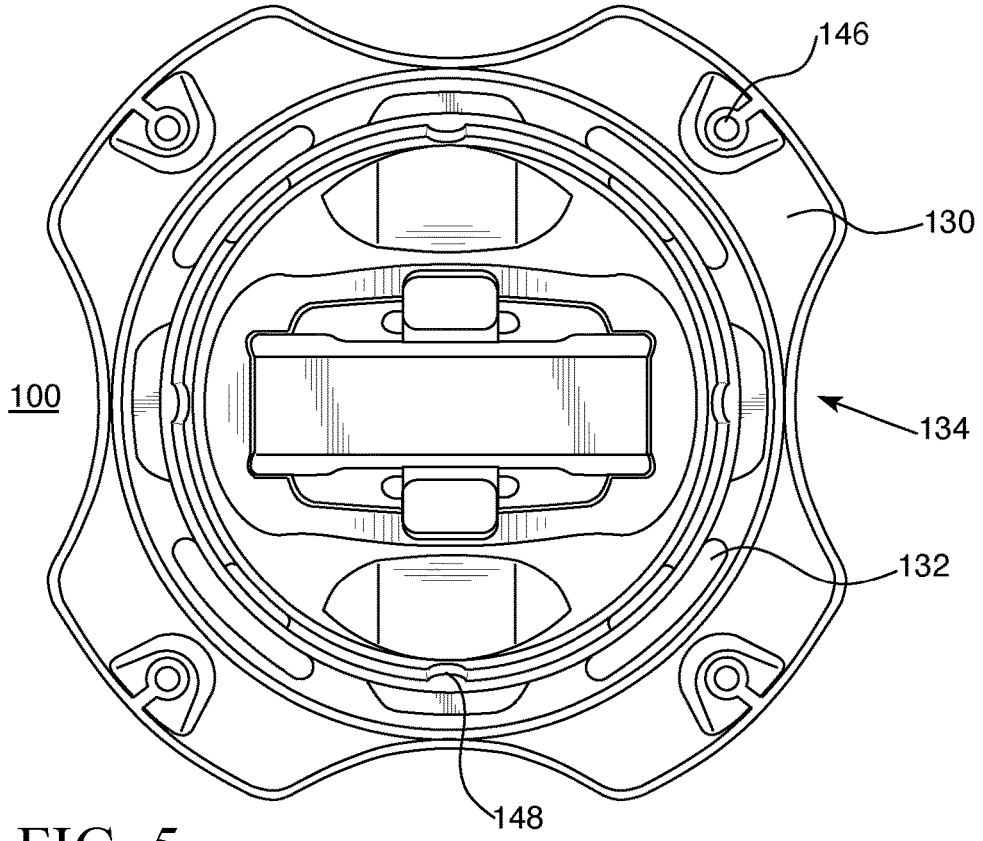
FIG. 5 is a bottom elevational view of the disclosed modular training device.

To couple mounting device 100 with hockey puck 300, hockey puck can be pressed into at least one hollow base portion so that an outer circumference of hockey puck 300 has a friction fit with an inner surface of at least one hollow base portion. Therefore, in some cases, in order to accommodate at least a portion of puck 300, mounting device 100 can have a circular bottom face, and at least one hollow base portion, such as upper base portion 124 or lower base portion 126. In other cases, mounting device 100 may, in addition to upper base portion 124 and lower base portion 126, have fins 130 projecting outwards from the lower base portion, and hockey puck 300 may be mostly or entirely covered by the fins, as illustrated in FIGS. 5-6.

More specifically, as illustrated in FIG. 6, mounting device 100 may define a hollow interior 124*a* of upper base portion 124 and hollow interior 126*a* of lower base portion 126, and hockey puck 300, when inserted, may be disposed in either or both hollow interior 124*a* and 126*a*, and create a friction/interference fit with the interior walls of the corresponding base portion 124 or 126 bounding the hollow interior. In some embodiments, as illustrated in FIGS. 5-6, upper base portion 124 may include stops 148 to prevent hockey puck 300 from extending into the hollow interior 124*a* of upper base portion 124. Additionally, lower base portions 126 may include tabs 150, as illustrated in FIG. 1, to grip hockey puck 300 once inserted and can flex a distance between its inner surface and the inner surface of the remaining wall. Stops 148 and tabs 150 can project inward from the upper and lower base portions 124, 126 toward the hollow interior of mounting device 100. In some embodiments, stops 148 may project further inward or may be less flexible than tabs 150 so as to keep hockey puck 300 in lower hollow interior 126*a* and to prevent the hockey puck from proceeding up into upper hollow interior 124*a*.

Additionally, as illustrated in FIGS. 1-8, mounting device 100 may accommodate variations in hockey puck sizes as well as provide stability to the device and puck combination to prevent tipping of the device when in use. For example, mounting device 100 may include a set of fins 130 to provide stability and relief apertures, such as horizontal slits 132, to accommodate variations in hockey puck sizes.

Fins 130 can project radially outward from the base portion and/or lip at a roughly perpendicular angle to the longitudinal device axis or at a non-perpendicular angle, such as one greater than 180 degrees, as illustrated in FIG. 2. In some cases, fins 130 may be structured and configured to include horizontal slits 132 near their connection points to the base portion. Horizontal slits 132 can be shaped to curve along the base of fins 130, as illustrated in FIGS. 1 and 4-5. Therefore, mounting device 100 may be structured and configured to include one or more horizontal slits 132 between each fin 130 and the hollow base portion, such as the lower base portion 126, as illustrated in FIGS. 1 and 4-5. Horizontal slits 132 can provide flexibility to base portions 124, 126 and fins 130 so that base portions and fins can more readily expand and contract when needed (for example, to couple with hockey puck 300). Additionally, horizontal slits 132 can enable mounting device 100 to have a diameter sized equal to or slightly smaller than hockey puck 300, therefore enabling a tighter grip on the hockey puck when the two objects are paired together.

As illustrated in FIG. 4, there can be four fins 130. However, the number of fins 130 is not limited to four. In some cases, there can be one fin that projects out around the entire circumference of the mounting device 100. In other cases, there can be two or more fins. While it is envisioned, in one embodiment, that a plurality of fins 130 will be equally spaced out, it is not required, and it is possible that fins 130 may even be of varying sizes themselves. Similarly, horizontal slits 132 can be spaced equidistant or at various distances from each other and may be of the same or varying sizes.

As illustrated in FIGS. 1-5, some embodiments of mounting device 100 include a curved or arced gap 134 between each fin 130. To accommodate gaps 134, horizontal slits 132 can have a length shorter than the length of the portion of fin 130 where it meets base portion 126. This enables mounting device 100 to include gaps 134 between fins 130 while maintaining fins' connection with the base portion and allowing the device to maintain the ability to accommodate various puck sizes.

In some embodiments, fins 130 may, in addition to providing stability due to an increased horizontal profile size, be structured and configured to suction to the ground to ensure mounting device 100 does not tip over when it is not coupled with hockey puck 300. In other embodiments, fins 130 may include attachment points for securing each fin to a surface to keep it in place. More specifically, attachment points may enable mounting device 100 to adhere to ground surface, such as dirt or ice, and/or to a wall surface. When secured or adhered to a ground surface, mounting device 100 can be used for training, as described above. When secured or adhered to a wall surface, mounting device 100 can be used for storage of elongated objects, such as sports sticks (for example, hockey or lacrosse) or pipes.

As illustrated in FIGS. 1 and 4-5, attachment points may be comprised of cavity 142 on each fin 130, and the cavity can include a hole 146 into which a fastener can be received and inserted. In some cases, the fastener can be an ice spike 144. In other cases, the fastener can be a nail or a drywall screw and anchor. The cavity 142 on fin 130 can be sunken, as illustrated in FIGS. 1-3 so that only a minimum portion of the fastener remains above the surface when the fastener is inserted and secured. Further, the fastener can then minimally protrude, if at all, above the cavity after securing mounting device 100 to the surface. As illustrated in FIG. 6, when the fastener is ice spike 144, a bottom portion of each ice spike can extend past the bottom plane of fins 130 in order to make contact with ice or any other firm ground surface such as, but not limited to, dirt, grass, turf, etc. Similarly, a nail or screw can also extend past the bottom plane of fins 130.

Ice spikes 144 can project out from the underside of mounting device 100 and can be structured and configured to penetrate ice and prevent device from sliding out of place when another object, such as, but not limited to, a hockey puck, hockey stick, or person, makes contact with it. Ice spikes 144 can be elongated objects having a peg (not illustrated) with pointed tip 154 and grip 152, as illustrated in FIGS. 1, 6 and 10. For example, ice spikes 144 can be ice screws. In some embodiments, as described above, the peg can insert through hole 146 in fin 130, and grip 152 can act as a stopper to prevent ice spike 144 from sliding entirely through the hole. The peg can be long enough that pointed tip 154 is the only portion of the peg to project out from the bottom plane of mounting device 100, as illustrated in FIG. 10. In some embodiments, each mounting device 100 can have four ice spikes 144. However, any number of ice spikes 144 can be used for each mounting device 100.

Each grip 152 can be structured to have two prongs, as illustrated in FIGS. 1 and 10, although any number of prongs is possible (for example, one centered prong or three prongs equidistant from each other). The prongs can be rigid and can be sharp enough to penetrate ice, thereby allowing mounting device 100 to anchor itself to ice and prevent movement even when contact is made with it by another object. The prongs can also make it easier for a user to easily grab ice spike 144 and separate ice spike from mounting device 100.

In addition to creating a clearance height, coupling hockey puck 300 with mounting device 100 can add mass to mounting device 100 and improve the ability of mounting device 100 to act as a base for an elongated object as well as a barrier for user. Therefore, when training with mounting device 100 that is coupled with hockey puck 300, it may be more difficult for a user to accidentally move or knock over mounting device 100 than if device was being used without hockey puck 300. This is especially true if mounting device 100 is secured to the ground with fasteners.

To separate mounting device 100 from hockey puck 300, the device can be deformable so a user may squeeze side projections 104 inward. This action may result in a gap or separation between a portion of the outer circumference of hockey puck 300 and the inner surface of the hollow base portion, which can reduce the friction between mounting device 100 and the hockey puck. This reduction in friction may allow a user to pull hockey puck 300 free from mounting device 100 and thereby separate the objects from each other. Another feature that may assist with coupling or separation of mounting device 100 and hockey puck 300 is a textured surface of lower base portion 126, as illustrated in FIG. 1, wherein the textured surface can include alternating protrusions around the circumference of lower base portion 130. For example, a user may gain a better grip on mounting device 100 by gripping textured surface of lower base portion 126. This improved grip can help a user either push mounting device 100 onto puck 300 or pull the device off of the puck. The textured surface can also incorporate tabs 150 as they have been described above and illustrated in FIG. 1.

To further enhance the ease with which a user can separate the mounting device 100 and hockey puck 300, the outer surface 120 of a side projection 104 can define an indented grip portion 122, as illustrated in FIGS. 1 and 3-5. Grip portion 122 may have a rounded and vertically elongated shape to ergonomically accommodate a user's fingers and make the separation process easier. To enhance the ergonomics further, side projection 104 may have a rounded top. This combination of side projection's rounded top and elongated shape of grip portion 122 can make it intuitive and easy for user to grab mounting device 100 at grip portion 122 and squeeze side projections 104 together.

Indented grip portion 122 may also have sloped or beveled side edges 128, as illustrated in FIG. 1, to help guide a user's finger down into the center depression of grip portion where squeezing will be most effective for the action of separating mounting device 100 and hockey puck 300. Beveled side edges 128 can also help prevent a user's finger from slipping out of grip portion 122 since, to slip out, user's finger would have to slide up from the center depression of grip portion and over the beveled side edges. To further prevent user's finger from sliding out of grip portion 122, all or a portion of grip portion (for example, the center depression area) may have a textured surface. Additionally, horizontal slits 132 may provide enough initial separation from puck 300 to assist a user in fully separating mounting device 100 from the puck.

In addition to coupling with elongated objects, such as pipe 800 or hockey stick shaft 900, and hockey puck 300, two or more mounting devices 100 may couple with each other. The configuration of each mounting device 100 enables a user to stack multiple mounting devices 100 together for easy transportation. Another benefit of stacking multiple mounting devices 100 together, aside from easy transportation, is that a resulting height of stacked devices may accommodate training with different types of equipment. For example, as mentioned above, coupling one mounting device 100 with puck 300 and pipe 700, shaft 800, or bridging component 900 may create a clearance height that is tall enough for hockey puck 1000 to freely slide underneath the pipe, shaft, or bridging component. Extending this idea further, coupling multiple mounting devices 100 with each other, with puck 300, and with pipe 700, shaft 800, or bridging component 900 may create a larger clearance height that is tall enough for ball 1200 to slide or roll underneath the pipe, shaft, or bridging component. Further, in other embodiments, a single mounting device 100 may have clearance height c3 that is tall enough for puck 1000 and ball 1200 to freely slide or roll underneath pipe 700, shaft 800, or bridging component 900 as illustrated in FIGS. 7-8.

Therefore, to enable mounting devices 100 to couple with each other, a portion of at least one of the devices may be hollow. In some cases, an entirety of a mounting device 100 is hollow, as illustrated in FIG. 6. Therefore, when mounting devices 100 couple with each other, side projections 104 of a first device can slide into hollow interior **102*a* of the main body of a second device and can nestle into the hollow interior of the main body of second device. Alternatively, hollow interior 102*a* of a main body of first device can be placed over the top of a second device and the second device can be twisted around until side projections 104 of the second device properly align with the hollow interior of the main body of first device, and therefore the first device can slide entirely on top of the second device. Once coupled, fins 130 of an upper device may rest on top of lower base portion 126 of a lower device. In an alternate configuration, fins 130 of each mounting device 100** may be nestled on top of each other with contact made between each device's lips or fins.

There is no limit envisioned in regard to the number of mounting devices 100 that can be stacked; any device can simultaneously nest with additional devices on its bottom and/or its top, although in some circumstances it may only nest with a second device on one or the other side. Further, while hollow versions of mounting device 100 have been described herein, it is envisioned that, in some cases, only a portion of the device may be hollow while still maintaining devices' ability to couple with each other. Alternatively, some embodiments of the device may be solid and, therefore, may only couple with a hollow version if the hollow version of the device is placed on top of the solid version, or the solid version may not couple at all with other devices or with hockey puck 300. In this case, the increased weight of the solid nature of device may offset its inability to couple with hockey puck 300. Further, if the device is solid, it may also have a taller circular base portion so that it can maintain its ability to act as a base for an elongated object while permitting puck 1000 or ball 1200 to freely slide or roll underneath the elongated object.

To help a user separate mounting devices 100 from each other, as described above, a user may squeeze grip portions 122 on each side projection 104 inward toward each other and into the central channel 106. This action can result in a gap or separation between a portion of the outer surface of the lower device and the inner surface of the upper device, which can reduce the friction between the lower and upper devices. This reduction in friction may allow a user to pull the devices apart and thereby separate the devices from each other.

As briefly mentioned above, some embodiments of the disclosed device may be made of a semi-rigid material so that it retains some flexibility. More specifically, mounting device 100 may be made of injection-molded polypropylene. In other embodiments, mounting device 100 can be made of injection-molded polyethylene, thermoplastic polymers (for example, ABS), or glass-filled polymers or plastics (for example, glass-filled polyamide). While specific materials are disclosed herein, other thermoplastic polymers or plastics could also be used.

Persons of ordinary skill in arts relevant to this disclosure and subject matter hereof will recognize that embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments.

Moreover, elements described with respect to one embodiment can be implemented in other embodiments even when not described in such embodiments, unless otherwise noted.

For purposes of interpreting the claims, it is expressly intended that the provisions of 35 U.S.C. 112(f) are not to be invoked unless the specific terms "means for" or "step for" are recited in a claim.

What is claimed is:

1. A modular training system comprising:

a mounting device having:

a main body with two side projections structured and configured to together define a central channel therebetween, wherein each side projection has at least one tab projecting into the central channel, and at least one base portion located below the main body; and a bridging component having a tubular body, a base extension that extends along a lower portion of the tubular body, and a plurality of projecting rails that extend out from and along left and right outer surfaces of the tubular body, wherein the bridging component is releasably secured to the mounting device in a horizontal configuration within the central channel, each projecting rail of the bridging component has a planar, upward facing surface that engages with the at least one tab of each side projection of the main body, at least a portion of the planar, upward facing surfaces of the projecting rails are approximately perpendicular to the surface of the tubular body and approximately parallel to the engaging face of the side projection, and the tubular body has a cross-section that is approximately circular in shape and the base extension has a cross-section that is approximately rectangular in shape.

2. The modular training system of claim 1, wherein the tubular body is hollow.

3. The modular training system of claim 2, wherein the tubular body has an interior interface comprising alternate elongate ridges and channels spaced equidistant from each other and extending along the interior interface.

4. The modular training system of claim 2, wherein the tubular body has a gap extending along a length of the tubular body.

5. The modular training system of claim 1, wherein an outer surface of the base extension of the bridging component is defined by three walls, the three walls being three flat faces.

6. The modular training system of claim 5, wherein two of the three walls are parallel to each other and project radially outward from the lower outer surface of the tubular body, and one of the three walls is perpendicular to the two, parallel walls.

7. The modular training system of claim 6, wherein the outer surface of the base extension of the bridging component is a hollow channel.

8. The modular training system of claim 7, wherein the one, perpendicular wall has a gap extending along a length of the one, perpendicular wall.

9. The modular training system of claim 1, wherein the plurality of projecting rails extend continuously from a first end of the tubular body to a second end of the tubular body.

10. The modular training system of claim 1, wherein the planar, upward facing surfaces of the plurality of projecting rails are ledges that align underneath the at least one tab of each of the two main body side projections.

11. The modular training system of claim 1, wherein the central channel of the mounting device is comprised of an upper cavity and a lower cavity, the lower cavity being narrower than the upper cavity.

12. The modular training system of claim 11, wherein the at least one tab of each of the two main body side projections are located in the upper cavity.

13. The modular training system of claim 1, wherein the bridging component is releasably secured to a plurality of mounting devices in a horizontal configuration within a central channel of each mounting device.

14. The modular training system of claim 1, wherein the at least one base portion of the mounting device is hollow and is structured and configured to releasably couple with a hockey puck via an interference fit.

15. The modular training system of claim 1, further comprising a set of fins projecting radially outwards from the at least one base portion.

16. The modular training system of claim 11, wherein the bridging component has an outer surface that aligns approximately with contours of the side projections that define the upper cavity and the lower cavity of the central channel.

17. The modular training system of claim 16, wherein the base extension of the bridging component fits in the lower cavity and the tubular body of the bridging component fits in the upper cavity.

18. The modular training system of claim 17, further comprising a second deformable tab on each of the main body side projections, wherein the second deformable tabs are located in the lower cavity of the central channel.

19. A bridging component for a modular training system comprising:

a tubular body having a cross-section that is approximately circular;

a base that extends from a lower portion of the tubular body and has a cross-section that is approximately rectangular; and a plurality of projecting rails that project radially outward from a curvature of the tubular body to define a planar, upward facing surface and that extend along left and right outer surfaces of the tubular body, wherein the bridging component is releasably securable to a mounting device in a horizontal configuration and within a central channel of the mounting device, the mounting device having a main body with at least two side projections structured and configured to together define the central channel therebetween, wherein each side projection has at least one tab projecting into the central channel, and at least one base portion located below the main body, and wherein the planar, upward facing surfaces of the projecting rails are engageable with the at least one tab of each side projection of the main body.

* * * * *